United States Patent [19]

Marciniak

[11] Patent Number: 4,544,023

[45] Date of Patent: Oct. 1, 1985

[54] AIR HEATING AND COOLING APPARATUS

[76] Inventor: Walter J. Marciniak, 4657 Xenia Ave. North, Crystal, Minn. 55422

[21] Appl. No.: 533,208

[22] Filed: Sep. 16, 1983

[51] Int. Cl.[4] ..... F25B 29/00

[52] U.S. Cl. ..... 165/48 R; 62/263; 165/57

[58] Field of Search ..... 165/48 R, 29, 57, 129; 62/262, 263, DIG. 16, 324.1

[56] References Cited

U.S. PATENT DOCUMENTS

| | | | |
|---|---|---|---|
| 2,743,908 | 5/1956 | Tanner | 62/263 |
| 2,847,834 | 8/1958 | Atchison | 62/263 |
| 3,097,506 | 7/1963 | Blakesley, Sr. | 62/263 |
| 3,123,987 | 3/1964 | Moore | 62/263 |
| 3,308,634 | 3/1967 | Smith | 62/263 |
| 3,831,395 | 8/1974 | Levy | 62/263 |
| 4,013,120 | 3/1977 | Rheinheimer | 62/263 |
| 4,027,498 | 6/1977 | Fessler | 62/263 |
| 4,424,684 | 1/1984 | Waldschmidt et al. | 62/263 |

FOREIGN PATENT DOCUMENTS

| | | | |
|---|---|---|---|
| 2478277 | 9/1981 | France | 129/ |

*Primary Examiner*—Albert J. Makay

*Assistant Examiner*—Steven E. Warner

*Attorney, Agent, or Firm*—Kinney & Lange

[57] ABSTRACT

A heat exchange apparatus is mountable in an exterior building wall structure having an exterior wall panel and interior wall panel. The apparatus includes a frame, a pivotal panel member and a cover door. The frame is attached to the wall structure proximate an opening in the exterior wall panel. The cover is detachably attached to the frame and the panel member pivots from a closed to an open position. The panel member is hingedly attached to the frame. A heat exchange system, such as an air conditioning or a heat pump system, or both, is mounted on the panel member so that when the cover door is removed, the panel member may be swung open, providing easy access to the heat exchange system for maintenance. The panel member, when in the closed position, divides the interior of the housing into interior and exterior air flow sections. The cover door has an air intake and an air discharge communicating with the exterior air flow section, and the interior wall panel of the building wall has an air intake and an air discharge communicating with the interior air flow section.

11 Claims, 6 Drawing Figures

AIR HEATING AND COOLING APPARATUS

BACKGROUND OF THE INVENTION

1. Field of the Invention

The present invention relates to air conditioning/heat pump systems, and in particular, it relates to air conditioning/heat pump systems that are installed onto the wall of a building and accessible from the exterior of the building.

2. Description of the Prior Art

Air conditioning systems in residential buildings are generally of two types. The first is a central air conditioning system wherein the compressor and condenser coils are positioned outside of a home and the expansion valve and evaporator coil are positioned inside of a forced air furnace within the home. This type of air conditioning system has little application in a home not having a forced air heating system.

The second type of air conditioning system is a window air conditioner unit. Although the purchase and installation cost of a window air conditioning unit is less than a central air conditioning unit, the window air conditioner has many disadvantages. The window air conditioner is much more inefficient than a central air conditioning system and more costly to run. The unit has to be relatively small to be placed within a window and the placement of the coils and the size of the coils along with the size of the compressor do not permit a very efficient design. The window air conditioner is also quite noisy since the fans and the compressor are enclosed generally in thin, relatively uninsulated sheet metal and plastic. In addition, the window air conditioner, when placed in a window, blocks much of the view through the window and partially extends into the room taking valuable space. Furthermore, a window air conditioner cannot be placed in a casement-type window which is being used in many of today's more energy efficient homes. Lastly, the window air conditioner is inefficient in its distribution of cold air into the room since the air intake and discharge are in close proximity due to the small size of the unit.

Several prior art patents describe air conditioning units that are mountable within or onto a wall structure. The Lauer U.S. Pat. No. 3,045,448, the Smith U.S. Pat. No. 3,308,634, the Okuma et al U.S. Pat. No. 3,785,434 and the Fessler U.S. Pat. No. 4,027,498 disclose air conditioning systems either mountable on a wall or within a wall. However, none of the above-mentioned patents teaches or suggests an air conditioning system suitable for residential home use.

SUMMARY OF THE INVENTION

The present invention includes a heat exchange apparatus that is mountable within a wall structure of a building for transferring heat between the interior of the building and the outside environment.

The apparatus includes a housing defining an enclosure. The housing includes a frame, a pivotal mounting means, a mounting panel and an exterior cover door. The frame is attachable to the wall structure proximate an opening in an exterior surface of the wall. The mounting panel is pivotally attached by the pivotal mounting means to the frame and is pivotal from a closed position to an open position. The panel, when in the closed position, divides the enclosure.

A refrigeration system is mounted on the panel such that heat is transferred through the refrigeration system between the exterior air flow section and the interior air flow section. The cover door is detachably attached to the frame member so that when the cover door is removed, the panel is pivoted to an open position exposing the refrigeration system for easy maintenance thereof.

DETAILED DESCRIPTION OF THE PREFERRED EMBODIMENT

Figure 1:
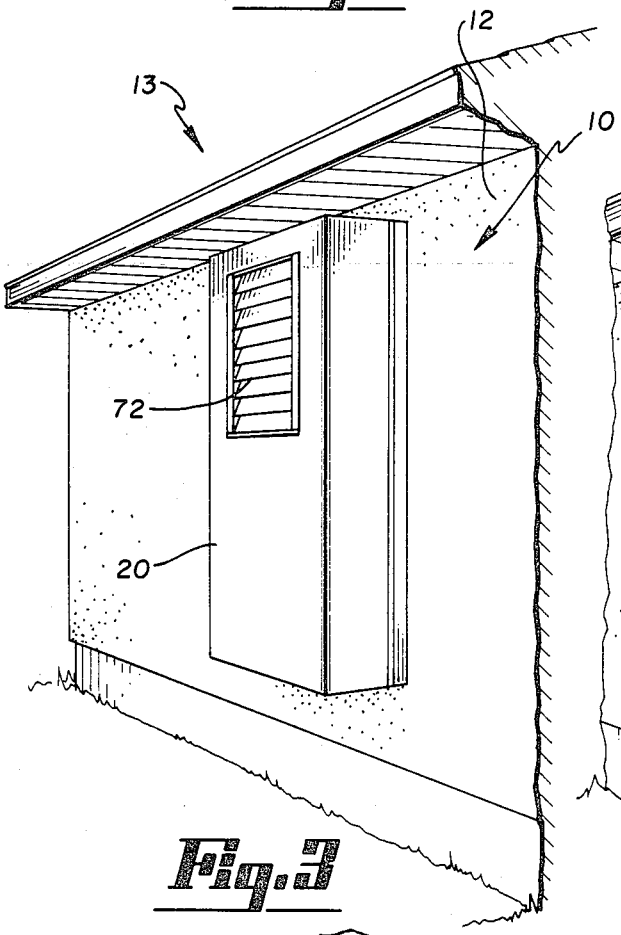
FIG. 1 is a perspective view of the apparatus of the present invention from the exterior of a building.
Figure 2:
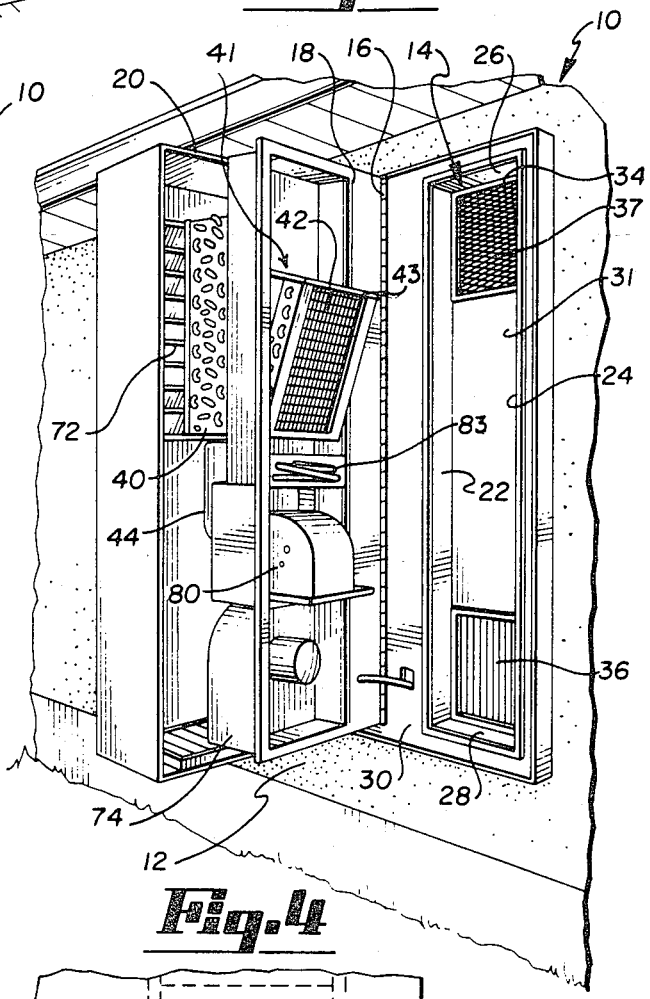
FIG. 2 is a perspective view of the apparatus with the panel member pivoted to an open position.

The apparatus of the present invention is generally indicated at 10 in FIGS. 1 and 2. The apparatus 10 is mounted onto a wall structure 12 of a building 13. The wall structure 12 is of a type that is normally found in residential buildings and includes a plurality of substantially vertical spaced-apart studs attached at their lower ends to a base and connected at an upper end by a header board. An interior wall panel and an exterior wall panel are mounted on to opposite sides of the studs. The interior wall panel is typically made of gypsum board and the exterior wall panel typically includes siding, insulating board and plywood. The standard convention in spacing studs from each other in a wall of a residental building is sixteen inches (16") between stud centers. Standard two by four (2×4) studs are approximately one and one-half inches (1½") wide and therefore the spacing from the surface of one stud to the next adjacent stud is fourteen and one-half inches (14½"). The apparatus 10 is preferably designed to be mountable between two adjacent studs that are spaced only fourteen and one-half (14½") apart.

The apparatus 10 of the present invention includes a frame member 14, a hinge 16 preferably running the vertical length of the frame member 14, a pivotal panel member 18 and a cover door 20. The panel member 18 is connected to the frame member 14 by the hinge 16.

Figure 4:
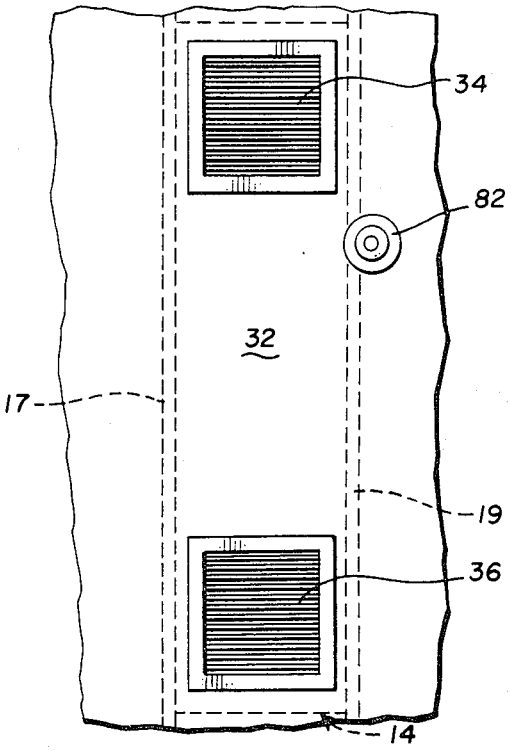
FIG. 4 is an elevational view of an interior wall of a building showing an air intake and an air discharge of the apparatus.

The frame member 14 is inserted into an opening formed in an exterior wall 15 between two adjacent studs 17 and 19, as illustrated in FIG. 4. The frame member 14 preferably includes first and second spaced-apart side walls 22 and 24, respectively, and an upper wall 26 and a lower wall 28 connecting the first and second side wall members to each other at their upper and lower ends, respectively. The first and second side walls 22 and 24 and the upper and lower walls 26 and 28 are also connected at exterior edges to a sheet metal partition wall 30 that surrounds the opening bound by walls 22, 24, 26 and 28 and forms part of the frame 14 on the exterior of the building wall. The hinge 16 actually mounts on partition wall 30.

The side walls 22 and 24 are positioned adjacently to the studs 17 and 19 which are exposed by the opening in the exterior wall panel. The frame member 14 is attached to the wall structure 10 by securing the side walls 22 and 24 to the studs with wood screws or other suitable fasteners.

Figure 3:
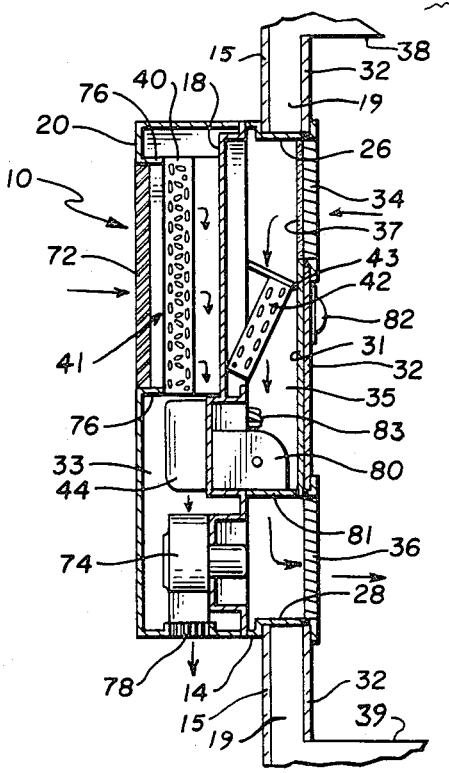
FIG. 3 is a cross sectional view of the apparatus showing the placement of the various major components of the refrigeration system with the panel member in a closed position.

The apparatus preferably has an inner sheet metal wall 31 attached to the inner edges of side walls 22 and 24. The inner sheet metal wall 31 is positioned adjacent an interior wall panel 32 of the wall structure 12, as illustrated in FIG. 3, when the side walls 22, 24 are attached to the studs 17 and 19.

Preferably, the frame member 14 is made of continuous galvanized steel and the hinge 16 is made of stainless steel. The cover door 20 is preferably made of aluminum with the exterior surface being painted with a suitable color.

The cover door 20 is attached to the frame member 14 preferably with sheet metal screws and when attached to the frame member 14 defines an enclosure in which heat is transferred between the interior of the building 13 and the outside environment. When the cover door 20 is attached to the frame member 14 and the panel member is in the closed position, as illustrated in FIG. 3, the panel member divides the enclosure into an exterior air-flow space 33, and an interior air-flow space 35. Outside air is circulated through the the exterior air-flow space 33 and air from the interior of the building is circulated through interior air space 35.

An upper air intake 34 is disposed at the upper end of the frame 14 and provides an air passage through the interior wall panel 32. An air discharge 36 is disposed at a lower end of the frame 14 and provides an air passage through the interior wall panel 32. In one working embodiment, the air intake 34 includes a single louvered grill which houses a one-inch thick washable filter 37 that is easily accessible from the exterior of the building, as indicated in FIG. 2. In addition, the same working embodiment includes a double deflection grill at the air discharge 36 which has louvers positioned to deflect air flowing through the unit downwardly as well as outwardly at each side into the room.

In a preferred embodiment, the present invention includes a refrigeration system 41 that has both an air conditioning mode and a heat pump mode. The refrigeration system 41 is mounted on the panel member 18, as illustrated in FIGS. 2 and 3. The refrigeration system 41 is best illustrated in a schematic flow diagram in FIG. 5.

The apparatus 10, through upper air intake 34, removes warm air proximate a ceiling 38 of the building for cooling and returns the cooled air proximate the floor, as illustrated in FIG. 3. The air within a building at about the seven foot (7′) height level and up to the ceiling 38 is typically the warmest air. Cooling the warmest air within the interior of the building results in a greater temperature drop of the air being cooled and results in more efficient utilization of the apparatus when in the air conditioning mode.

Furthermore, when the apparatus is in the heat pump mode, the warmed air will be circulated proximate a floor 39. Cooler air is generally found near the floor 39 and distributing warm air near the floor results in an efficient use of the warmed air.

Figure 5:
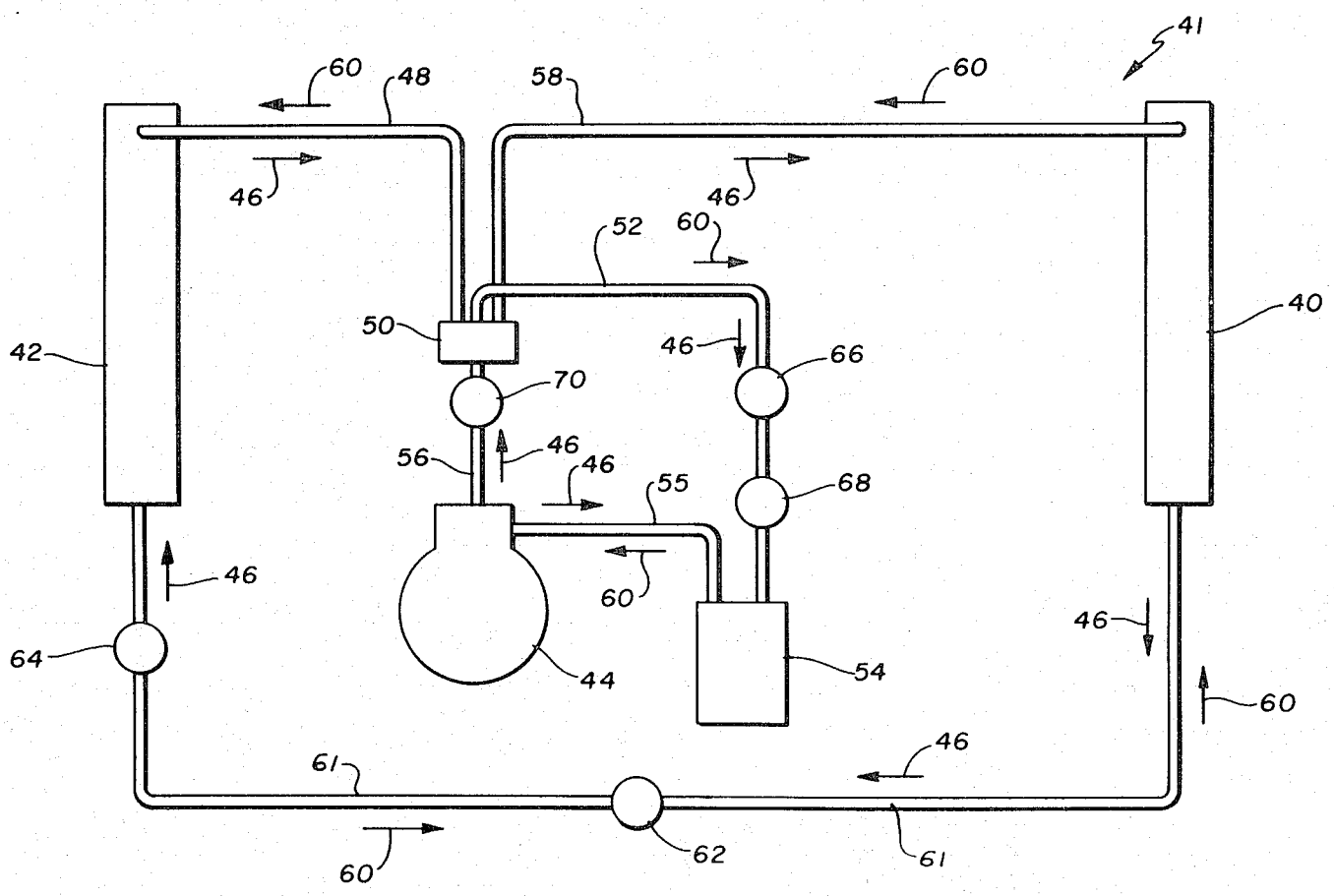
FIG. 5 is a schematic flow diagram of the refrigeration system of the present invention.

The air conditioning mode of the refrigeration system 41 is illustrated by arrows 46 in FIG. 5 which indicate the flow of heat exchange fluid. The indoor coil 42 acts as an expansion coil and the outdoor coil 40 acts as a condenser in the air conditioning mode. The indoor coil 42 is disposed on the suction side of the compressor 44 and refrigerant fluid flows through conduit 48 into a reversing valve 50 and then into conduit 52 into an accumulator 54 which is one the suction side of the compressor 44. From the compressor 44, the fluid is discharged through conduit 56, through the reversing valve, into conduit 58 and into the outdoor coil 40. Heat is transferred to the outside air through the outdoor coil 40. The cool and condensed refrigerant then flows through conduit 61 and through a conventional-type thermostatic expansion valve 62 into the door coil (expansion coil) wherein heat is absorbed from air being circulated within the air space 35 from the interior of the building.

When the refrigeration system is operating in the heat pump mode, the reversing valve is switched to connect the conduit 52 with the conduit 58, and the conduit 56 is connected with the conduit 48. In the heat pump mode, the flow of the fluid is in the direction indicated by the arrows 60. Fluid having absorbed heat through the outdoor coil 40 is conveyed through conduit 58 through the reversing valve 50, into conduit 52, into the accumulator 54, and into the compressor through conduit 55. Fluid is then compressed by the compressor 44 and conveyed through conduit 56, through the reversing valve 50, through conduit 48, into the indoor coil 42 wherein heat is transferred from the fluid to the air flowing through the interior air space 35. From the coil 42, fluid is conveyed through conduit 61, through the expansion valve, and into the outdoor coil 40 for absorption of heat from the outside air flowing through space 33.

The refrigeration system preferably includes a sight glass 64 for monitoring the level of the heat exchange fluid (refrigerant) in the system. A line filter dryer 66 is positioned on the suction side of the compressor 44 along with a low pressure cut-off 68 for shutting the system down due to low pressure. In addition, a high pressure cut-off 70 is included on the discharge side of the compressor 44 for shutting the refrigeration system down due to high pressure.

The coils 40 and 42 are uniquely positioned within the exterior air flow space and interior air flow space for maximum heat transfer efficiency and for installation of the unit between studs that are spaced approximately fourteen and one-half inches (14½″) apart. As illustrated in FIG. 2, the outdoor coil 40 is mounted on the panel member 18 in a substantially vertical position. The cover door 20 includes an air inlet 72 at an upper end thereof positioned at approximately the same level as the outdoor coil 40. As illustrated in FIG. 3, the cover door 20 has an inner flange portion 76 which abuts against the outdoor coil 40 so that fresh outside air is forced over the coils 40. A fan 74 is mounted over an air discharge opening 78 positioned at a bottom end of the cover door 20 to draw air within air space 33 and to expel air outside the cover door 20 whenever the system is operation. The compressor 44 is preferably mounted above the fan 74 on the panel member 18.

The indoor coil 42 is mounted on the panel member 18 in a position slightly inclined from vertical. The lower end of the coil 42 is mounted on the panel member 18 and an upper end of the coil 42 abuts against the sheet metal wall 31 proximate the lower end of the air intake 34 when the panel member 18 is in a closed position. A rubber gasket 43 is disposed along the edge of the coil 42 that abuts against the wall 31 to ensure that the air coming in through the intake 34 passes over as much surface of the coil 42 as possible.

A blower 80 is mounted on the panel member 18 below the coil 42 on a substantially horizontal plate 81 extending from the panel member 18. The plate 81 abuts against the sheet metal wall 31 dividing the interior air space 35 into an upper and lower interior air space, restricting any air flow between the upper and lower air spaces except through the blower 80. The plate 81 insures that only air coming through the air intake 34 is conveyed by the blower 80 and further ensures that the air passing through air space 35 passes through the coil 42.

The apparatus 10 also includes an electric heater 83 mounted on the panel member 18 between the indoor coil 42 and the blower 80. The heater 83 is turned on when the heat pump mode of the apparatus is being used.

The remaining elements and conduits of the refrigeration system, as illustrated in schematic flow diagram of FIG. 5 and described previously, are also mounted on the panel member 18, although not explicitly shown in FIGS. 2 and 3. Full access is provided for service and maintenance of the components of the refrigeration system since the components are mounted on panel member 18. As illustrated in FIG. 2, when the cover door is removed, the panel member 18 is pivotable from a closed position to an open position on the hinge 16. Both the outdoor coil 49 and the indoor coil 42, along with the blower 80, the compressor 44, the sight glass 64, the dryer 66, the reversing valve 50, the accumulator 54, and associated conduits are positioned for easy maintenance and cleaning. As previously mentioned, the filter 37 of intake 34 can be easily removed for cleaning when the panel member is in the open position. Since the apparatus 10 is serviceable from the exterior of the building, a garden hose can be used to wash the coils along with both the exterior and interior air intakes and air discharges.

Figure 6:
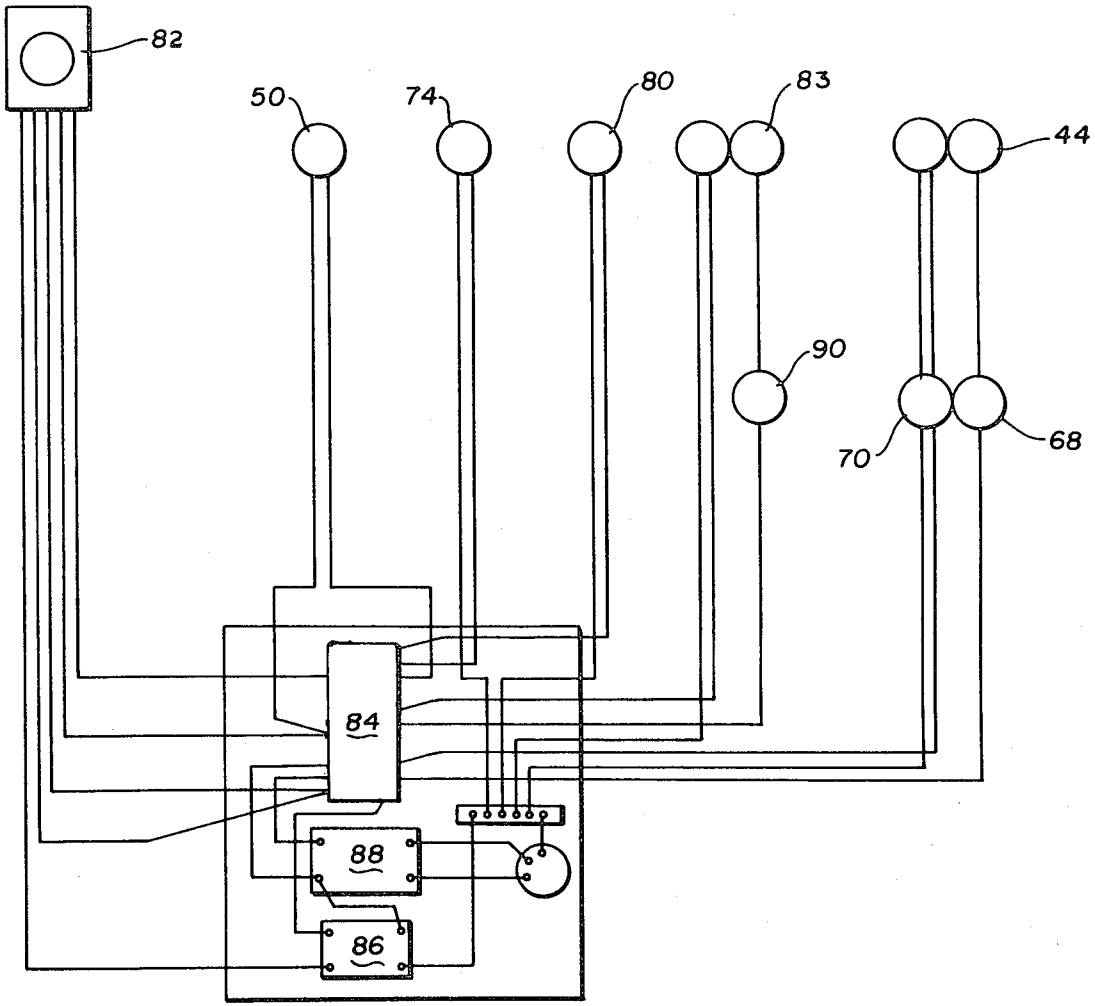
FIG. 6 is a unit wiring diagram of the apparatus.

The present invention further includes a thermostat control 82, mounted on the interior wall 32 of the building, as illustrated in FIGS. 3 and 4. The thermostat 82 is a conventional unit, a manual switch is used to switch the refrigeration system from the air conditioning mode to the heating mode and controls various refrigeration components, as illustrated in the unit wiring diagram of FIG. 6. The manual switch of thermostat 82 controls the operation of the reversing valve so in the "cooling" mode the flow is as shown by arrow 46, and in the heating mode, the flow is as shown by arrows 60. When in the air conditioning mode, the thermostat turns on the compressor 44, both fans 74 and 80 through control relays 84. Likewise, the thermostat energizes the compressor 44, both fans 74 and 80 and the heater 83 through control relays 84. However, the heater 83 does not come on immediately, but only turns on when the heat pump fails to satisfy a predetermined temperature. A conventional duct thermostat device 90 is placed in series between the relays 84 and the electic heater 83 and turns the electric heater 83 on when the duct temperature is lower than a set point on the device. A transformer 86 supplies the thermostat and the relays with low voltage power. A fuse 88 protects the motors of the fan 74, the compressor 44 and electric heater 83 from overloading.

The apparatus 10 of the present invention is easily installed in the wall structure of a building. An opening is cut into the exterior wall panel 15 of the wall structure 12 between two adjacent studs with the opening extending between oppositely facing surfaces of two adjacent studs and sufficient in height to accommodate frame 14. A second opening is cut into the interior wall panel 31 proximate the ceiling and a single deflection grill with a one inch (1") thick washable filter is mounted within the second opening. A third opening is cut into the interior wall panel 31 proximate the floor and a grill for discharging the air back into the room is mounted within the third opening. The frame 14 and the panel member 18, along with all the various components of the refrigeration system 41 is attached to the two adjacent studs with wood screws. After the frame is attached to the studs, the thermostat controls are attached to the transformer 86, the fuse box 88 and the relays 84. The fuse box, the transformer and the relays are connected to a 220 volt power source within the home. Lastly, the exterior cover door 20 is secured by sheet metal screws to the frame member.

In summary, the apparatus of the present invention provides a unique solution for cooling and heating a home that cannot have central air conditioning and a window air conditioner is not desirable or possible. The apparatus is easily intalled on the exterior of a home in an opening in the exterior wall between two studs. The apparatus does not extend into the interior of the home taking up valuable space. The only part of the apparatus that is visible from the interior of the home is the air intake, the air discharge and the thermostat. Since the interior wall of the home insulates the interior of the home from the noise of the refrigeration system the apparatus 10 is much quieter than a window air conditioning unit. In addition, the cleaning and maintenance of the refrigeration components and filters is easily done from the exterior of the home eliminating any mess within the home.

Although the present invention has been described with reference to preferred embodiments, workers skilled in the art will recognize that changes may be made in form and detail without departing from the spirit and scope of the invention.

What is claimed is:

1. A heat exchange apparatus mountable within an opening in a wall structure of a building for transferring heat between the interior of the building and the environment, said wall structure having an interior wall panel and an exterior wall panel, the interior wall panel having an interior air intake and an interior air discharge means communicating with the interior of the building, the apparatus comprising:

a housing defining an enclosure and having a frame, a pivotal mounting means, a panel member and an exterior cover door, the frame member being attachable to the wall structure, the panel member having an interior surface and an exterior surface and being pivotally mounted by the pivotal mounting means to the frame and being pivotal between a closed position and an open position, the panel member dividing the enclosure into an interior air space portion and an exterior air space portion, the interior air space portion communicating with the interior of the building through the interior air intake and the interior air discharge means, the cover door being detachably attached to the frame so that the panel member is accessible and is permitted to pivot to the open position, the cover door including an exterior air intake and an exterior air discharge means for permitting exterior air to flow within the exterior air space; and heat transfer selectively mounted on the exterior and interior surfaces of the panel member so that heat is selectively transferred between the interior air space portion and the exterior air space portion and such that when the panel member is pivoted to the open position, the heat transfer means is accessible from the exterior of the building for maintenance.

2. The apparatus of claim 1 wherein the interior wall panel and the exterior wall panel of the wall structure are mounted on substantially vertical spaced-apart stud members and the opening within the wall structure is between two spaced-apart stud members and wherein the frame has first and second spaced-apart substantially vertical side wall members which are attachable to the first and second stud members positioning the housing at least partially within the opening, said first and second side wall members connected to each other by at least one connecting member.

3. The apparatus of claim 1 wherein the pivotal mounting means is a hinge pivotally attaching an edge of the panel member to the frame member.

4. The apparatus of claim 1 wherein the interior air intake is proximate a ceiling of the interior of the building and the interior air discharge is proximate a floor of the interior of the building so that air proximate the ceiling of the interior of the building is initially cooled by the heat transfer means.

5. The apparatus of claim 4 wherein the air intake includes a filter accessible from the exterior of the building when the panel member is in an open position.

6. The apparatus of claim 1 wherein the heat transfer means includes a refrigeration system wherein a gaseous refrigerant is compressed to remove heat therefrom and expanded to absorb heat, including an exterior coil means mounted on the panel member in the exterior air space portion and an interior coil means mounted in the interior air space portion, and including a compressor mounted on the panel member and fluidly connected with the exterior and interior coils, and including valve means for changing the refrigerant gas from a high pressure state to a low pressure state, and means for reversing the flow of refrigerant gas so that the refrigerant system can transfer heat from the interior of the building to the exterior or transfer heat from the exterior to the interior of the building.

7. The apparatus of claim 6 wherein the interior coil is pivotally mounted on the panel member at a lower end and slightly inclined toward the interior wall panel of the building, abutting said interior wall panel at an upper end and positioned below the interior air intake.

8. The apparatus of claim 6 and further including an electric resistance heater mounted on the panel member and including means for turning the electric heater on at a predetermined temperature when the refrigeration system is in the heat pump mode.

9. The apparatus of claim 6 wherein the means for circulating air within the interior air space is a blower fan mounted on the panel member and the panel member includes a plate member extending therefrom toward the interior wall of the building, abutting said wall of the building when the panel member is in the closed position.

10. A heat exchange apparatus mountable within an opening in a wall structure of a building for transferring heat between the interior of the building and the environment, said wall structure having an interior wall panel and an exterior wall panel, and the building having a ceiling defining an upper end of the interior wall panel and a floor defining a lower end of the interior wall panel, the apparatus comprising:

a housing defining an enclosure and having a frame for attachment to the wall structure and an exterior cover door detachably attachable to the frame from the exterior of the building, the cover door having an air intake and discharge means;

means for dividing the enclosure of the housing into an interior air space portion and an exterior air space portion, mounted on the housing frame and being movable between a closed position within the housing and an open position substantially outside the housing;

an interior air intake disposed in the interior wall panel proximate the ceiling for permitting air to flow into the interior air space portion of the enclosure from the interior of the building;

an interior air discharge disposed within the interior wall panel proximate the floor for permitting air to flow from the interior air space portion into the interior of the building; and heat transfer means selectively mounted on the means for dividing the enclosure so that heat is selectively transferred between the interior air space portion and the exterior air space portion and such that when the means for dividing is moved to the open position, the heat transfer means is accessible for maintenance.

11. The apparatus of claim 10 wherein the housing further includes a hinge means and wherein the means for separating the enclosure is a panel member pivotally mounted by the hinge means to the frame and being pivotal between a closed position and an open position so that the heat transfer means is accessible from the exterior of the building for maintenance when the cover door is detached from the frame and the panel member is pivoted to the open position.

* * * * *

UNITED STATES PATENT AND TRADEMARK OFFICE

CERTIFICATE OF CORRECTION

PATENT NO. : 4,544,023

DATED : October 1, 1985

INVENTOR(S) : Walter J. Marciniak

It is certified that error appears in the above-identified patent and that said Letters Patent is hereby corrected as shown below:

Claim 6, lines 12 & 13, "the refrigerant system" should read --the refrigeration system".

Signed and Sealed this

*Third* Day of *December 1985*

[SEAL]

*Attest:*

DONALD J. QUIGG

*Attesting Officer*

*Commissioner of Patents and Trademarks*